United States Patent [19]

Grisbrook

[11] Patent Number: 4,492,529

[45] Date of Patent: Jan. 8, 1985

[54] COMPRESSORS EFFICIENCY IMPROVEMENT

[76] Inventor: Robert B. Grisbrook, 594 Gederson La., Kirkwood, Mo. 63122

[21] Appl. No.: 390,385

[22] Filed: Jun. 21, 1982

[51] Int. Cl.[3] ..... F04B 25/00; F04B 39/10

[52] U.S. Cl. ..... 417/242; 417/267; 417/439; 417/490

[58] Field of Search ..... 417/242, 267, 439, 490; 91/409

[56] References Cited

U.S. PATENT DOCUMENTS

| | | | |
|---|---|---|---|
| 740,771 | 10/1903 | McIntyre | 417/242 |
| 765,923 | 7/1904 | Herriot | 417/490 X |
| 899,720 | 9/1908 | Elder | 417/242 |
| 1,050,287 | 1/1913 | Olson | 91/409 X |
| 1,187,606 | 6/1916 | Brush . | |
| 1,264,562 | 4/1918 | Rix | 417/242 |
| 1,272,651 | 7/1918 | Foster | 417/267 X |
| 1,343,449 | 6/1920 | Harley-Mason | 91/409 |
| 1,632,684 | 6/1927 | Tuckfield . | |
| 3,123,287 | 3/1964 | Neubauer . | |
| 3,338,509 | 8/1967 | McAninch | 417/242 |
| 3,613,646 | 10/1971 | Hisada . | |
| 3,713,513 | 1/1973 | Harris et al. . | |

*Primary Examiner*—William L. Freeh
*Assistant Examiner*—T. Olds
*Attorney, Agent, or Firm*—Kalish & Gilster

[57] ABSTRACT

The cylinder of a reciprocating compressor is provided with a flanged collar defining an annular recess adjacent the side walls of the cylinder bore disposed for entry of the piston skirt during the downstroke into the recess, compressing gas therein. Communication is provided between the recess and the space above the piston and cylinder head, increasing the initial pressure above the piston and causing greater pressure to be developed during the compression stroke. The result is an increase in the volumetric efficiency of the compressor.

8 Claims, 9 Drawing Figures

FIG. 5
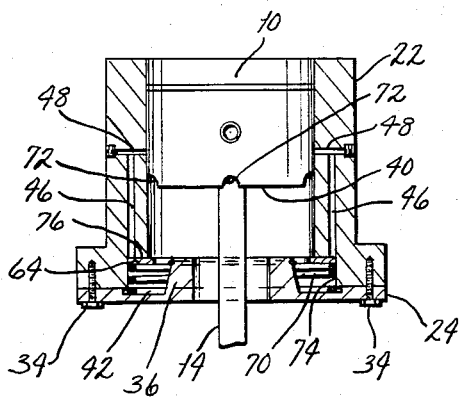
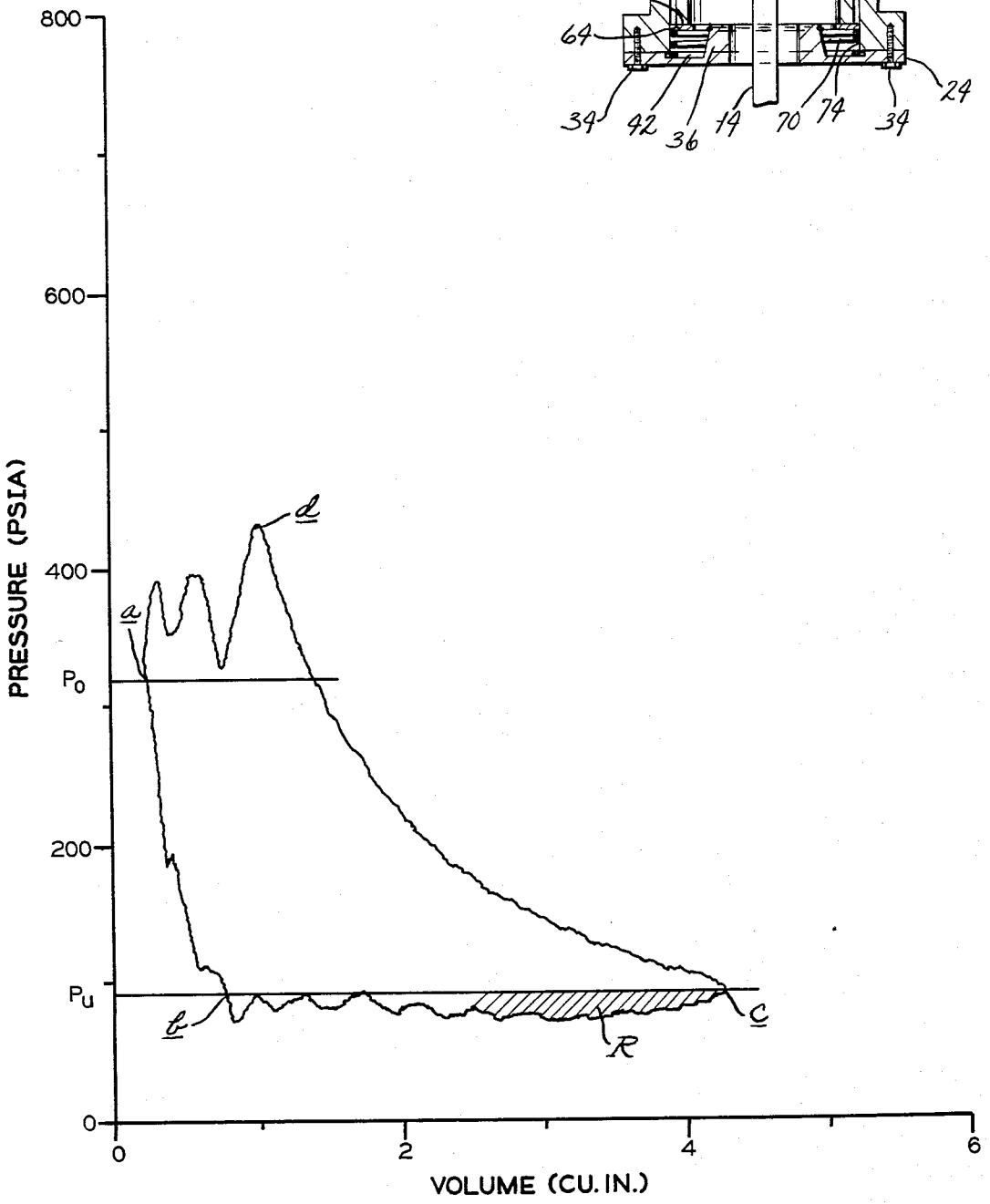
FIG. 6

COMPRESSORS EFFICIENCY IMPROVEMENT

BACKGROUND AND SUMMARY OF THE INVENTION

This invention relates to positive displacement compressors and, more particularly, to improved reciprocating compressors of the type for compressing air and other gases.

Positive displacement compressors are of the type in which successive volumes of air or other gas are confined within a closed space and are elevated to a higher pressure. Reciprocating compressors are positive displacement compressors of the type in which the pressure is increased as the volume of the closed space is decreased. There are many types of reciprocating compressors. They are used for such purposes as compressing air, refrigerants, various industrial gases, as well as in air conditioners and heat pumps.

Traditionally, although volumetric efficiency of reciprocating compressors has been a relatively important design consideration, it has had relatively little significance to the compressor user. However, owing to the increases in the price of electrical energy which is increased with the price of fossil fuels and general inflationary tendencies, and the need to provide greater performance for a given size of compressor and, thus, improve performance without increase in the cost of materials or manufacturing, volumetric efficiency has now become a matter of high concern.

Moreover, there has traditionally been substantial competition among compressor manufacturer representatives so that even relatively small increases in the volumetric efficiency and improvements of the overall efficiency of the compressors is a matter of great commercial concern, particularly since the users and purchasers of compressors are now increasingly conscious of such efficiencies. The effective power efficiency is a parameter by which compressors are sometimes now specified.

Effectively, the volumetric efficiency of a reciprocating compressor is the actual capacity (i.e., during the inlet stroke during which gas is drawn into the cylinder) to the piston displacement. Customarily, the volumetric efficiency is expressed as a percentage, the theoretical value of which for a given compressor is reduced by certain insufficiencies and losses.

It is an object of the present invention to provide an improved reciprocating compressor which may be utilized for compressing air and other gases, such as, for example, air conditioning, heat pumps, pneumatic compression, and for various other gas compression purposes.

It is a further object of the invention to provide such a compressor having increased volumetric efficiency with consequently improved effective power efficiency.

It is also an object of this invention to provide such a system for improving the efficiency of reciprocating compressors which can be readily incorporated into existing types of reciprocating compressors without drastic redesign or departure from the fundamental design concepts of such compressors.

The invention has as a still further object the provision of such a system for improving the efficiency of reciprocating compressors which utilizes relatively simple, reliable and mechanically straightforward components which can be readily incorporated into such compressors during manufacture, and which will not conduce to shortening of the design life of such compressors nor be prone to wear, mechanical failure or damage to a compressor during use.

It is also an object of the invention to provide such a system for improving the efficiency of reciprocating compressors which does not substantially interfere with the assembly or manufacture of such compressors and which can be readily incorporated during manufacture.

It is also an object of the invention to provide a device which can be utilized with existing compressor designs to modify the cylinder configuration of existing compressors without altering otherwise the method or principles of operation of the compressor to improve the volumetric efficiency characteristic of the compressor without change in the intrinsic displacement of the compressor.

Briefly, in accordance with the invention, the cylinder of a reciprocating compressor is provided with a flanged collar defining an annular recess adjacent the side walls of the cylinder bore. The disposition of this recess is such that the piston during its downstroke descends into the recess to compress gas therein. Communication is provided between this recess and the head space between the piston and cylinder head. As the piston descends, gas within the recess, being compressed, is provided through the communication to the head space to provide an increase in the initial pressure therein over what would be present in the absence of such an arrangement. Accordingly, during the piston upstroke, greater pressure is developed during the compression stroke, resulting in an increase in the volumetric efficiency of the compressor with concomitant decrease in the amount of theoretical displacement lost to the development of underpressure during a cycle of operation.

BRIEF DESCRIPTION OF THE DRAWINGS

FIG. 5 is a vertical cross section of a further embodiment in accordance with the invention, showing only such portions of a compressor as are concerned with the invention.

FIG. 6 is a pressure-volume diagram in which the instantaneous pressure within the compressor is plotted as a function of its displacement volume.

Corresponding reference characters indicate corresponding parts throughout the several views of the drawings.

DESCRIPTION OF THE PREFERRED EMBODIMENT

Figure 1:
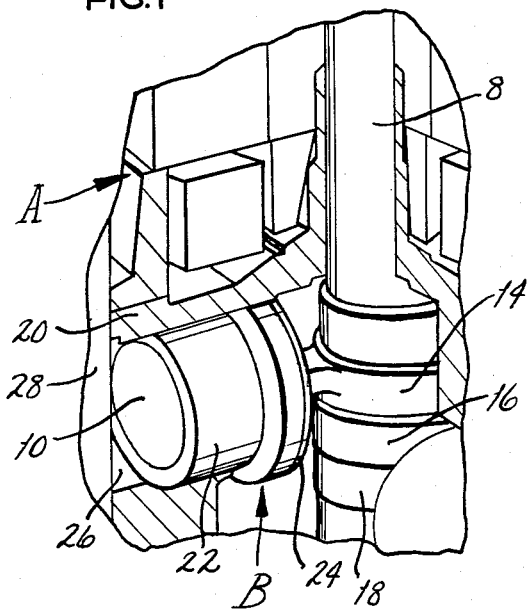
FIG. 1 is a cutaway illustration, in perspective, of a compressor incorporating efficiency improvements in accordance with the present invention.
Figure 2:
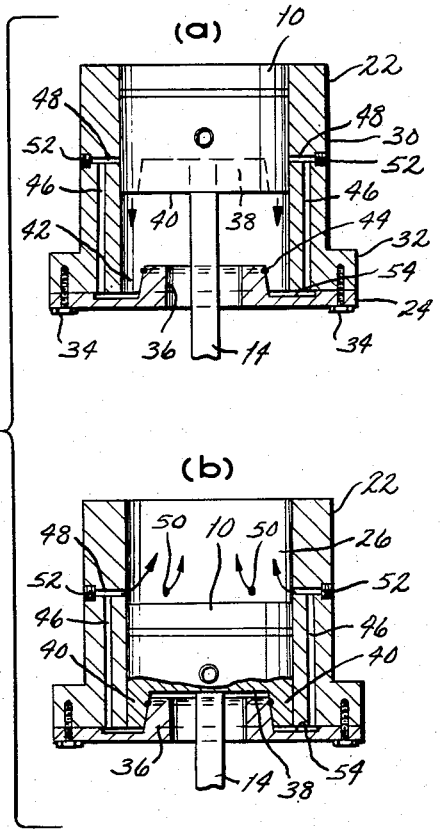
FIGS. 2*a* and 2*b* are vertical cross sections of portions of a compressor bore having a piston therein and incorporating structure of the new system of this invention, showing the piston during its downstroke and at its lower-most point, respectively.

Referring now to the drawings, and particularly to FIG. 1, reference character A generally designates a compressor which has been modified, in accordance with this invention, by the incorporation of apparatus B. Compressor A is shown as being of the multiple piston type having a vertical crankshaft 8 journalled within a crankcase 12 and to which are connected piston rods 14, 16 and 18. Crankcase 12 defines cylinder heads for each of the multiple pistons. Thus, a cylinder 20 is defined for piston 10 which is driven reciprocally within cylinder 20 by crankshaft 14. The configuration of compressor A is typical of the type used for air conditioning and heat pump compressors.

Generally, apparatus B involves the provision of a sleeve-like member 22 having at one end a flanged collar 24 which in cooperation with piston 10 will cause compression of gas within the compressor on the downstroke of piston 10. This compressed gas is provided under pressure to the space 26 between piston 10 and the cylinder head 28 to increase the initial charge of gas for compression by piston 10 during its compression stroke which is toward head 28. Of course, compressor A is provided with the usual valves which may be of the reed type or any of various other types but, merely for purposes of illustration of the present invention, may be assumed to be of the reed type.

Referring to FIG. 6, the pressure-volume diagram shown therein represents a cycle of operation of a compressor of this type. At point a, the piston is at the end of its stroke and a certain volume of gas at discharge pressure is trapped in the clearance volume or head space 26. The volume present within space 26 at that moment may be termed the clearance and represents the volume present within cylinder 20 over and above the volume displaced by the compressor during its compression stroke. As the piston begins its return stroke, the clearance gas expands until the pressure in cylinder 20 is slightly lower than the pressure in the intake line. This condition occurs at point b at which point the cycle begins to take in gas from the inlet port. The pressure varies relatively little during the entirety of the intake stroke, which is completed at point c, at which the piston is at the opposite end of its stroke and now begins a compression stroke compressing the gas along a line which terminates at a point d. The pressure at point d is greater than that existing in the discharge line and at which the discharge valve opens to allow the compressed gas to be discharged into the discharge ports. Characteristically of the reed valve type of compressor, the pressure may oscillate until reaching point a at which the cycle is repeated. Also shown on the diagram is the average overpressure $P_o$ and underpressure $P_u$.

The invention may be understood by considering its effect upon volumetric efficiency, which is a major determinant with which the design of a compressor is concerned.

The theoretical formula for volumetric efficiency is:

$$n = 1 - (r^{1/k} - 1)\, c$$

where:

r = The ratio of compression imposed upon the cylinder, i.e., the cylinder discharge pressure, psia, divided by the cylinder intake pressure, psia.

$k = c_p/c_v$ of the gas at atmospheric conditions (isentropic process).

c = The clearance in the cylinder stated as a decimal percentage of the cylinder displacement per stroke.

Practically, certain adjustments are made in the theoretical formula so that a typical equation which might be used in computing compressor performance looks like this:

$$n = 0.95 - (r^{1/k} - 1)\, c - L$$

In this practical formula, the values of r, k and c are the same as in the theoretical formula. The constant 1.00 has been reduced to 0.95 to correct for minor inefficiencies such as incomplete filling of the cylinder during the intake stroke. L is a practical correction for the conditions in a particular application which affect the volumetric efficiency and for which the theoretical formula is inadequate.

Volumetric efficiency decreases with increasing volume of the head space or cycle clearance 20. In the design of compressors every effort is made typically to decrease clearance 20 to a minimum by various expedients such as locating valves in cycle head 28 as close as possible to piston 10 and by the use of very thin valves, etc. Volumetric efficiency can also be increased by increasing the amount of gas initially drawn into the cycle along path b–c, so that a greater volume of gas will be displaced by the piston during its compression stroke. Region R represents a loss of available work of the compressor during which the actual pressure is less than the average underpressure. Region R can be diminished by providing an initial precharge of gas to space 26 during the last portion of the intake stroke of the piston.

Referring to FIGS. *2a* and *2b*, a first embodiment of the invention is demonstrated with dimensions exaggerated to more clearly illustrate relationships of elements and their operation. For simplicity, only elements 22 and 24 are shown, it being manifest from FIG. 1 that sleeve 22 encloses piston 10, with cylinder 20 having been modified appropriately for slidably receiving sleeve 22 from the crankshaft side, there being a cylindrical portion 30 of sleeve 22 which is fitted axially into the cylinder bore, and an outwardly extending flange portion 32 at the bottom of sleeve 22 to which collar 24 is attached as by screws 34.

Collar 24 is provided with an upstanding boss 36 shaped complementarily to the undersurface 38 of piston 10 for providing a closely fitted relationship with piston 10. Recess 38 provides the piston with a skirt 40 around its lower side. Boss 36 thus defines an annular recess 42 which skirt 40 will occupy when piston 10 is in its lowermost position as shown in FIG. *2b*. An O-ring 44 of suitable seal material may, if desired, be fitted into a groove at the upper end of boss 36 for providing a sealing relationship between boss 36 and inner surfaces of piston skirt 40 for preventing gas from escaping around boss 36 as the skirt enters recess 42.

A number of passages 46 and 48 are bored in sleeve 30, being of suitable dimension and extent for causing gas compressed by skirt 40 as it descends into recess 42 to be communicated to the space 26 above piston 10 when the piston has occupied or has nearly reached its lowermost position. Passages 48 open as indicated at 50 above piston 10 at a location just above the top of the piston when it occupies its lowermost position. Suitable plugs 52 block passages 48 exteriorly of sleeve portion 30. Also, collar 24 is provided with a shallow annular recess 54 around the periphery of boss 36 for flow of the gas compressed in recess 42 into passages 46. Flange 24 may be constructed of metal or various synthetic resin materials or may instead be formed of rubber or the like if not exposed to substantial stress or load.

Figure 3:
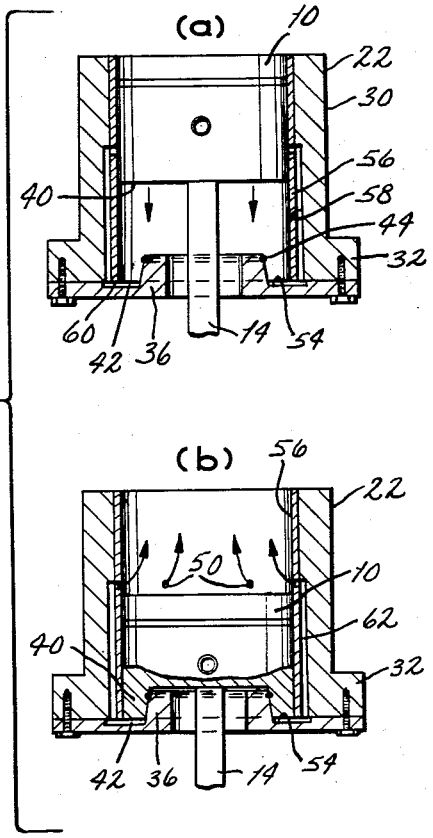
FIGS. 3*a* and 3*b* similarly are vertical cross sections of a compressor bore and piston therein as equipped with yet another embodiment of the invention and showing the downstroke and lowermost point of the piston, respectively.
Figure 4:
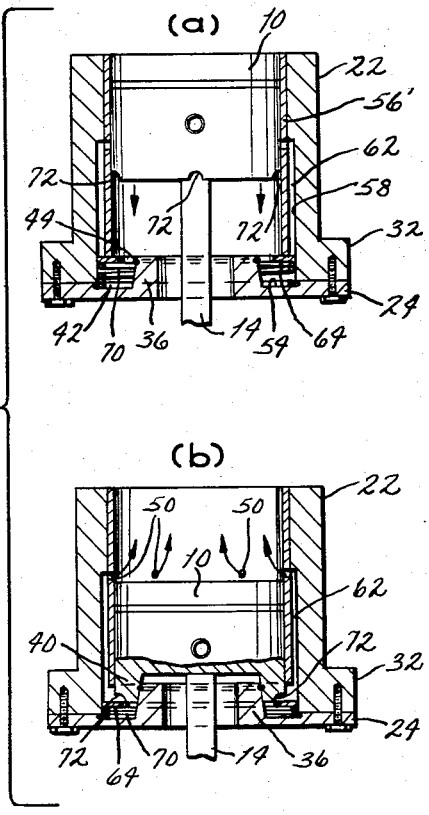
FIGS. 4*a* and 4*b* are similar vertical cross sections of such portions of a compressor as configured with yet another embodiment of the new system, also showing the downstroke and lowermost position of the piston, respectively.

FIGS. 3*a* and 3*b* demonstrate an alternative embodiment. Sleeve 22 is provided with its own sleeve 56 within which piston 10 reciprocates. Further, sleeve 22 is provided with an internal annular recess 58 which extends from the lower edge of its flange 32 to a point just above the upper surface of piston 10 when it is in its lowermost position, there being several openings 50 from the interior of sleeve 56 into recess 58 whereby gas compressed in recess 42 will be discharged through openings 50 into the space above piston 10 when it reaches its lowermost position. Sleeve 56 may be pressed into sleeve 22 and, as will be apparent, its lowermost edge 60 is positioned above the face of recess or groove 54 for passage of the compressed gas into the space 62 thus defined between the outside of sleeve 56 and recess 58. With reference now to FIGS. 4*a* and 4*b*, a further embodiment of the invention is demonstrated. Sleeve 22 is, like the preceding embodiment, provided with an internally fitted sleeve 56' which ends at a point substantially aligned with the upper surface of boss 36, there being as in the previous embodiment an annular space 62 surrounding sleeve 56' and created by recess 58 within sleeve 22 and with openings 50 above the piston 10 in its lowermost position opening into said space 62 to permit gas pressurized in recess 42 to be admitted into the space above piston 10 when it reaches its lowermost position.

Seated against the lower edge of sleeve 56' is a flat washer-like ring 64 which acts to seal the lower end of space 62 in the nature of a valve, ring 64 being biased against the lower edge by a spiral compression spring 70 which may be of ribbon-like character of very thin section whereby a tight sealing engagement of the lower edge of sleeve 56' is provided. Several openings 72 are provided at intervals around piston skirt 40 through which gas pressurized in recess 42 will pass when permitted by opening of ring 64. When piston skirt 40 descends into recess 36, it engages ring 64, the width of which is sufficient for being contacted by the piston skirt 40 as it descends. Accordingly, gas below piston skirt 40 is not admitted into space 62 until the piston skirt begins to enter recess 42, thereby enhancing the efficiency of the arrangement by entrapping the gas in recess 42 until an optimum pressurization thereof begins to occur at which it can be effectively communicated to the space above piston 10.

Although the various embodiments of the invention have shown the provision of sleeve 22 within the cylinder 20 as a separate member fitted within the bore and within which sleeve the piston will be reciprocal, it is also within the contemplation of the present invention that bores or other passages may be incorporated within the cylinder walls without the provision of sleeve 22, such as by drilling bores from the crankshaft end which will communicate with the cup-like recess of collar 24, and with lateral bores or the like, as at 48, being provided within the cylinder walls for communication above the piston during its downstroke, all as herein described and illustrated. In other words, passages 46 and 48 may be incorporated within the cylinder walls themselves rather than within sleeve 22. In this case, collar 24 may be directly fastened, as by bolts 34, to the cylinder structure.

Referring now to the embodiment of FIG. 5, sleeve 22 is modified to include a recess 74 adjacent its lower end which provides an extension of recess 42 and with the outer wall of recess 74 being cylindrical for permitting the ring-like valve member 64 to be seated against a shoulder 76 defined by recess 74. Passages 46 open into recess 74 through shoulder 76. Ring 64 is urged into position against shoulder 76 by spring 70, thereby closing off and sealing passages 46 unless the skirt 40 of piston 10, during its downstroke, engages ring 64, moving same downwardly to further compress spring 70 and thereby open passages 46 for communication with recess 42. As a result, piston skirt 40, as it enters recess 42, will compress the gas therein for discharge from recess 42 through passages 46, 48 into the space above piston 10, but only after ring 64 has been contacted by piston skirt 40. Openings 72 around the periphery of skirt 40 permit the pressurized gas to be communicated from recess 42 past skirt 40.

It will also be manifest that the embodiment of FIG. 5 can be realized without the provision of the separate sleeve 22, with recess 74 being instead provided within the lower end of the cylinder, and passages 46, 48 being bored directly therein.

In operation, each of the embodiments is seen to enhance the efficiency of compressor operation by providing a precharge of gas to the space above piston 10 which otherwise would not be present and thereby promotes a greater volume of displacement during the compression stroke.

In effect, underpressure actually existing within the intake system of the compressor as the piston moves through its intake stroke will be reduced by the surge or pulse of air or other gas communicated from the underside of the piston to the space above it. In this way, region R of the pressure-volume diagram is reduced. The effect is somewhat like that of supercharging wherein an extrinsic compressor is used with an internal combustion engine to increase the volume of the charge into the combustion chamber. But, in compressors of the present type, an effective gain in efficiency results by using the piston itself in a dual acting mode so that an auxiliary compression stroke is actually carried out as the piston moves down within crankcase 20.

It is manifestly evident from the drawings, that elements 22 and 24 may be readily incorporated into the compressor crankcase without doing violence to the design, allowing existing compressor designs to be readily modified for the inclusion of apparatus B of the invention. For purposes of assembly, collar 24 may be installed on the piston rod before the piston is connected and subsequently secured to element 22 by bolts 34.

Accordingly, it is seen that the various objects of the invention are attained and other advantageous results are achieved by the invention.

Although the foregoing includes a description of the best mode contemplated for carrying out the invention, various modifications are contemplated. For example, the cross section of collar 24 and its boss 36 may be varied appropriately, as may the cross section of the undersurface of piston 10 to readily accommodate such modified collar cross sections to improve still further the efficiency of the precharging effect of apparatus of the invention. Also, various valve arrangements differing from those shown in FIGS. 4*a* and 4*b* may be utilized, as well as differing from the arrangement of FIG. 5.

Since various modifications can be made in the constructions herein described and illustrated without departing from the scope of the invention, it is intended that all matter contained in the foregoing description or shown in the accompanying drawings shall be interpreted as illustrative rather than limiting.

What is claimed is:

1. A reciprocating compressor for use with a reciprocating compressor including a cylinder head, a cylinder and a skirt piston driven reciprocally therein by a crankshaft and connecting rod for compressing air or other gases by displacement within a space above said piston by alternate intake and compression strokes, an efficiency improvement device installed within the cylinder and defining an annular recess proximate the side walls of the cylinder below said piston, said recess being shaped complementarily to said piston skirt for providing a closely fitted relationship with, and being oriented relative to, said piston for receiving at least a portion of the skirt of said piston during its intake stroke for compressing of gas in said recess, said device being of flange-like configuration and including a flange portion extending laterally inwardly from the walls of said cylinder and carrying a central annular boss extending upward toward said piston for defining between said boss and the cylinder walls said annular recess, and means defining at least one passage between said recess and the space between said piston and cylinder head for causing gas compressed in said recess to be provided under pressure to said head space for increasing the initial charge of gas within said head space for compression by said piston during its compression stroke, thereby to increase the efficiency of the compressor said flange portion defining a central opening therein for said connecting rod, said boss including seal means for providing a sealing relationship between said boss and inner surfaces of said piston skirt for preventing gas in said recess from escaping around said boss as said skirt is received in said recess, said central opening having relatively larger diameter than corresponding dimensions of said connecting rod and whereby there is not provided a sealing relationship between said connecting rod and said device, and whereby there is no interference with movement of said connecting rod.

2. A reciprocating compressor according to claim 1 and further characterized by said passage-defining means comprising a sleeve fitted within said cylinder, said piston being reciprocal within said sleeve, said sleeve including passage means providing communication between said annular recess and the space above said piston.

3. A reciprocating compressor according to claim 2 and further characterized by said passage means comprising a plurality of ports opening within said sleeve above said piston when said piston is in its lowermost position, each of said ports communicating with said annular recess.

4. A reciprocating compressor according to claim 3 and further characterized by said sleeve carrying within it a further sleeve, the first-said sleeve being recessed internally to define between said sleeves a passage opening through said ports above said piston for communicating pressure from said annular pressure to above said piston.

5. A reciprocating compressor according to claim 4 and further characterized by a valve member movable between positions blocking and opening said passage, means resiliently biasing said valve member into blocking position, said valve member being oriented for being contacted by said piston during the piston downstroke for opening said passage.

6. A reciprocating compressor according to claim 5 and further characterized by said blocking member being constituted by an annular member of washer-like configuration, and located below said further sleeve for axial movement within the first-said sleeve between its blocking and opening positions, said biasing means comprising a coiled compression spring interposed between said valve member and an upper surface of said collar.

7. A reciprocating compressor according to claim 2 and further characterized by said sleeve having a peripheral, radially-outwardly extending flange at its lower, cylinder-head remote end, said collar being mated to and detachably secured to said flange.

8. A reciprocating compressor according to claim 1 and further characterized by a valve member movable between positions blocking and opening said passage, means resiliently biasing said valve member into blocking position, said valve member being oriented for being opened by said piston during the piston downstroke for opening said passage.

* * * * *